US006161617A

United States Patent [19]

Gjedebo

[11] Patent Number: 6,161,617

[45] Date of Patent: Dec. 19, 2000

[54] DEVICE FOR CONNECTING CASINGS

[75] Inventor: Jon Gjedebo, Stavanger, Norway

[73] Assignee: Hitec ASA, Forus, Norway

[21] Appl. No.: 09/254,379

[22] PCT Filed: Sep. 10, 1997

[86] PCT No.: PCT/NO97/00244

§ 371 Date: Mar. 5, 1999

§ 102(e) Date: Mar. 5, 1999

[87] PCT Pub. No.: WO98/11322

PCT Pub. Date: Mar. 19, 1998

[30] Foreign Application Priority Data

Sep. 13, 1996 [NO] Norway ..... 963823

[51] Int. Cl.[7] ..... E21B 19/00

[52] U.S. Cl. ..... 166/77.52; 166/380; 166/78.1

[58] Field of Search ..... 166/379, 380, 166/77.51, 77.52, 378, 77.1, 77.4, 78.1

[56] References Cited

U.S. PATENT DOCUMENTS

| | | | |
|---|---|---|---|
| 2,167,338 | 7/1939 | Murcell | 166/380 |
| 2,188,589 | 1/1940 | Armentrout | 166/377 |
| 3,747,675 | 7/1973 | Brown | 166/237 |
| 3,913,687 | 10/1975 | Gyongyosi et al. | 175/75 |
| 4,593,773 | 6/1986 | Skeie | 175/85 |
| 4,655,301 | 4/1987 | Verstraeten | 175/171 |
| 4,762,187 | 8/1988 | Haney | 175/171 |

FOREIGN PATENT DOCUMENTS

| | | |
|---|---|---|
| 285386 | 10/1988 | European Pat. Off. . |
| 154578 | 10/1986 | Norway . |

*Primary Examiner*—David Bagnell
*Assistant Examiner*—Jennifer R. Dougherty
*Attorney, Agent, or Firm*—Andrus, Sceales, Starke & Sawall, LLP

[57] ABSTRACT

A device serves to interconnect pipes (3) to form a casing (1). A new pipe (3) to be added to the top of the casing (1), is suspended from an elevator (4) assigned to a drawworks, the latter being assigned a top drive (7) above the elevator (4). The device comprises a tubular hydraulic telescopic (device (9, 10), one end thereof being connected to the output shaft (8) of the top drive (7), the other end thereof being provided with a catcher (11) adapted to catch, raise and rotate the pipe (3). The catcher (11) is adapted to be guided into the pipe (3) and to be expanded to rest against the pipe and, thus, to establish an internal friction connection.

4 Claims, 6 Drawing Sheets

DEVICE FOR CONNECTING CASINGS

BACKGROUND OF THE INVENTION

The invention relates to a device for connecting casings.

Oil and gas wells are lined by setting a pipe called a casing which is concreted into position through the supply of a cement slurry to the annulus outside the casing.

The casing is formed by interconnecting shorter pipes screwed one to the other by means of threaded connections. A new pipe is supplied to the top of the casing which, then, is lowered one pipe length down into the well. Before a new pipe can be added to the top of the casing, the latter is refilled with a liquid.

Pipes joined together to form a coherent casing are, at each end thereof, provided with an external threaded portion, and pipes are added to each other by means of an external socket having internal threads. Before a new pipe is added to the top of the casing, a socket is screwed halfway onto the threaded portion at the upper end of the pipe, so that the socket forms a small extension of the pipe. The new pipe is suspended from a collar, called an elevator, which is closed around the pipe below the socket. The pipe suspended from the socket can be rotated in the elevator.

The elevator is assigned a vigorous drawworks for vertical positioning. The pipe is lowered by means of the drawworks until threads at the lower end of the pipe come into contact with the complimentary threads in a socket at the top of the casing. A tool, a spinner, grips and surrounds the pipe and rotates it about its own axis in order to screw the pipe into the socket at the top of the casing. Then, the threaded connection is tightened to the moment prescribed by means of a moment tool. The casing is lowered, suspended from the socket at the upper end of the latest added pipe, down into the well, and the process is repeated, the socket at the upper end of the latest added pipe, now located at the upper end of the casing, being ready to accommodate the end of a new pipe.

The described prior art technique suffers from a plurality of disadvantages. The drawworks is a rough and coarse apparatus having a lifting capacity of several hundred tons. It is difficult to fine adjust the vertical position, and the threads are readily damaged when a new pipe is lowered towards the top of the casing. As the pipe is screwed into the top of the casing, it is necessary to readjust the position of the elevator, i.e. to lower the elevator. In order to avoid that the threads are rubbed or become damaged in another way, the pipe should be lowered such that there does not arise any significant axial force acting on the threads while the pipe is rotated and screwed to the top of the casing. As mentioned, this is difficult to achieve by means of the drawworks.

The spinner used to screw a new pipe to the top of the casing, is expensive. Also, it is very space-demanding, as it must be capable of surrounding the largest casings in use.

Filling liquid into the casing involves liquid spillage, making the drill floor slippery and dangerous, thus, entailing the need for constant washing down and cleaning.

SUMMARY OF THE INVENTION

An object of the invention is to provide a device securing an improved vertical positioning of a pipe to be screwed to the top of a casing. Another object is to avoid the use of the known spinner tool. Further, it is an object to achieve a simplified filling of liquid into the casing after a new pipe length has been added, and it is also an object to avoid liquid spillage.

The objects are obtained by means of features as defined in the following specification and claims.

According to the invention, a new pipe is suspended from an elevator as previously known. Further, it is presupposed that a top driven rotational system, a so-called "top drive", substantially used for drilling purposes, is assigned to the drawworks at a higher level than the elevator, as previously known.

In accordance with the invention, a tubular telescopic tool is, at one end thereof, adapted to be attached to the top drivers output shaft in a way corresponding to usual drill pipes.

Then, pipes, valves and other components used to supply liquid to drill pipes, may supply liquid to the tubular telescopic tool.

The lower end of the tool is telescopic and provided with a connector adapted to establish a tight connection with the upper end of a pipe suspended from the elevator. Further, the connector is adapted to transfer torsional moments and axial forces to the pipe. Thus, the top drive may rotate the tool and the pipe suspended from the elevator. The pipe may be lifted within the elevator by means of the telescopic lower end.

A pipe to be added to the top of a casing, is suspended from the elevator as previously known. The connector is guided down to the upper end of the pipe by means of the telescopic lower end and activated. Then, the pipe is raised somewhat by means of the telescopic lower end, the pipe sliding in the elevator which is not raised. The pipe is coarsely positioned above the top of the casing by means of the drawworks. Then, the pipe is lowered down to contact with the casing by means of the telescopic lower end and put into rotation by means of the top drive. The pipe is lowered gradually by means of the telescopic lower end as it is screwed to the top of the casing. Finally, the threaded connection is tightened to the moment prescribed. Liquid is refilled through a pipe systems usually assigned to the top drive. The connector is released and lifted clear of the top of the pipe, whereafter the casing is lowered into the well as previously known by means of the elevator, the process being repeated for each new pipe.

BRIEF DESCRIPTION OF THE SEVERAL VIEWS OF THE DRAWING

The tool as indicated above, is further described by means of non-restricting exemplary embodiments, reference being made to attached drawings, in which.

DETAILED DESCRIPTION OF THE INVENTION

Figure 1:
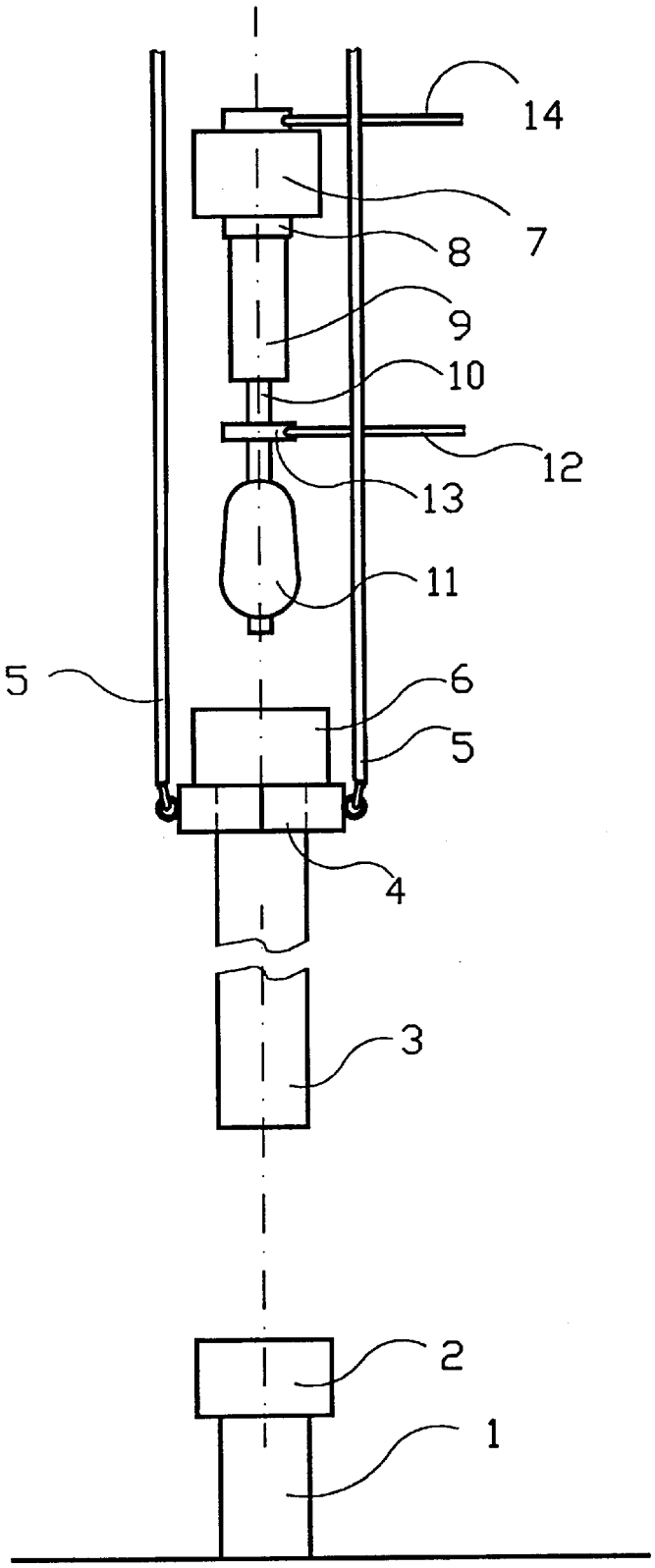
FIG. 1 shows diagrammatically a side elevational view of an apparatus for connecting casings, a catcher being ready to catch the upper end of a pipe to be added to the top of a casing.

In FIG. 1, reference numeral 1 denotes a casing to which to an externally threaded portion at the upper end of the casing 1 is screwed an external socket 2 provided with internal complementary threads. The socket 2 forms an internally threaded extension of the casing 1.

A pipe 3 which at both ends is provided with an externally threaded portion, is suspended with its lower end a short distance above the casing 1 and the socket 2 and is ready to be lowered such that the lower end of the pipe 3 becomes inserted into the upper end of the socket 2 and can be screwed into the socket 2.

The pipe 3 is suspended from an elevator 4 which, by means of bows, hoops or rods 5, is assigned a drawworks, not shown, incorporated in an arrangement common in connection with oil drilling. The elevator 4 is closed around the pipe 3 below a collar 6 which beforehand has been screwed externally onto the upper end of the pipe 3. The collar 6 forms an externally threaded extension of the pipe 3 which is suspended by the collar 6.

A top drive 7 (drilling machine) is, as usually, assigned to said drawworks. The output shaft 8 of the top drive 7 is attached to the upper end of a telescopic pipe 9, the length of which can be changed by pushing a pipe member 10, as previously known, out of and into the telescopic pipe 9, preferably by means of a hydraulic actuator, not shown. At the free end of the pipe member 10, a catcher or grapple 11 is disposed. This catcher 11 is adapted to be guided into the pipe 3 and to be expanded to rest against the pipe and, thus, to establish an internal friction connection. Liquid can flow through the telescopic pipe 9 and the pipe member 10, the pipe member 10 opening out below the catcher 11. Necessary energy and control signals to the actuator of the telescopic pipe 9 and to the catcher 11 are supplied through hoses 12 through a swivel device 13. Liquid for refilling the casing is supplied at the top drive 7 by means of a liquid pipe system 14 used for circulating drill fluid during drilling.

Figure 6:
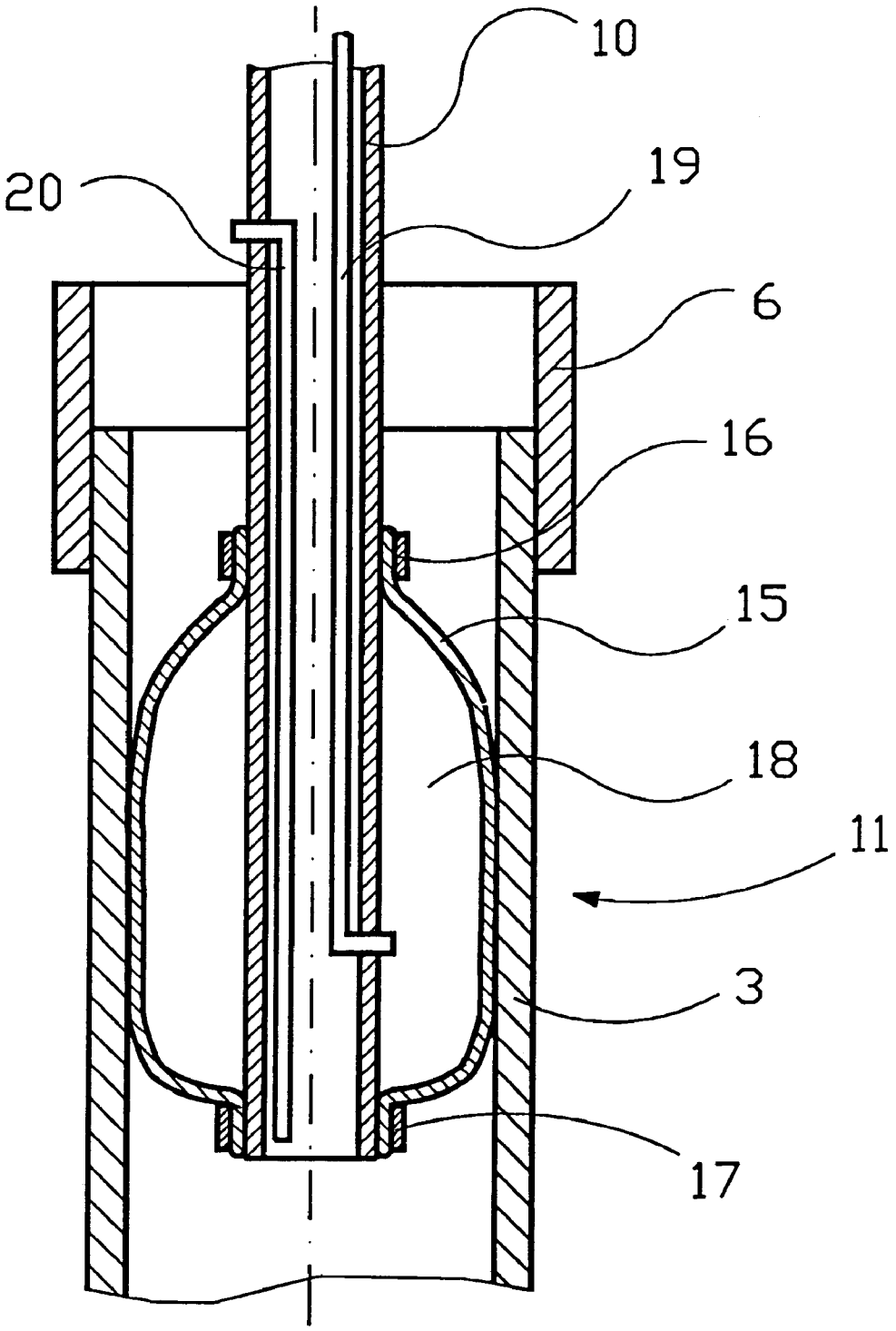
FIG. 6 shows in side elevational view, partly in section and on a larger scale, the catcher gripping the pipe internally.

Reference is made to FIG. 6 where the catcher 11 is shown in section, while it is active within the pipe 3. In the shown embodiment, the catcher 11 consists of a preshaped bellows 15 positioned outside the pipe member 10 and made of an elastic material such as rubber or plastics. At each end thereof, the bellows 15 has a diameter adjusted to the pipe member 10, and elsewhere a diameter somewhat less than the internal diameter of the pipe 3. At its upper and lower end, the bellows 15 is fastened to the pipe member 10 with an upper and lower external clamp 16, 17, so that a closed annulus 18 is formed between the pipe member 10 and the bellows 15. A pipe 19 extending within the pipe member 10, is conducted through the wall of the pipe member 10 and opens up in the annulus 18. Through the supply of pressurized liquid or gas through the pipe 19, the annulus 18 can be pressurized, so that the elastic bellows 15 is expanded for resting against the pipe 3, the pipe 19 being assigned a pressure source, not shown, through the swivel device 13 and one of the hoses 12.

Further, within the pipe member 10 is disposed a pipe 20 opening out at the lower end of the pipe member and communicating with free air above the bellows 15, either through the wall of the pipe member 10 such as shown, through the swivel device 13, or in another way, in order to conduct air out when the pipe 3 is filled with a liquid through the telescopic pipe 9 and the lower pipe member 10.

Figure 2:
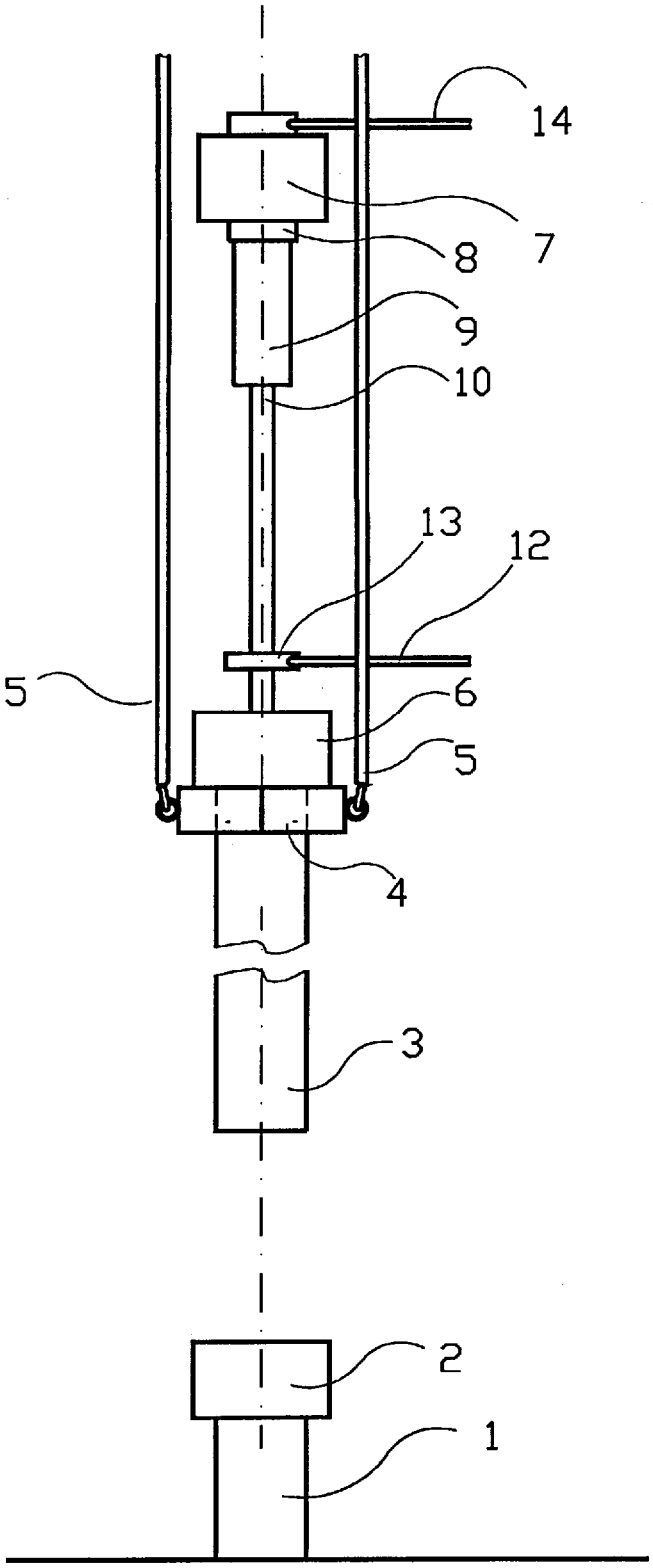
FIG. 2 shows the apparatus after the catcher has caught the pipe.
Figure 3:
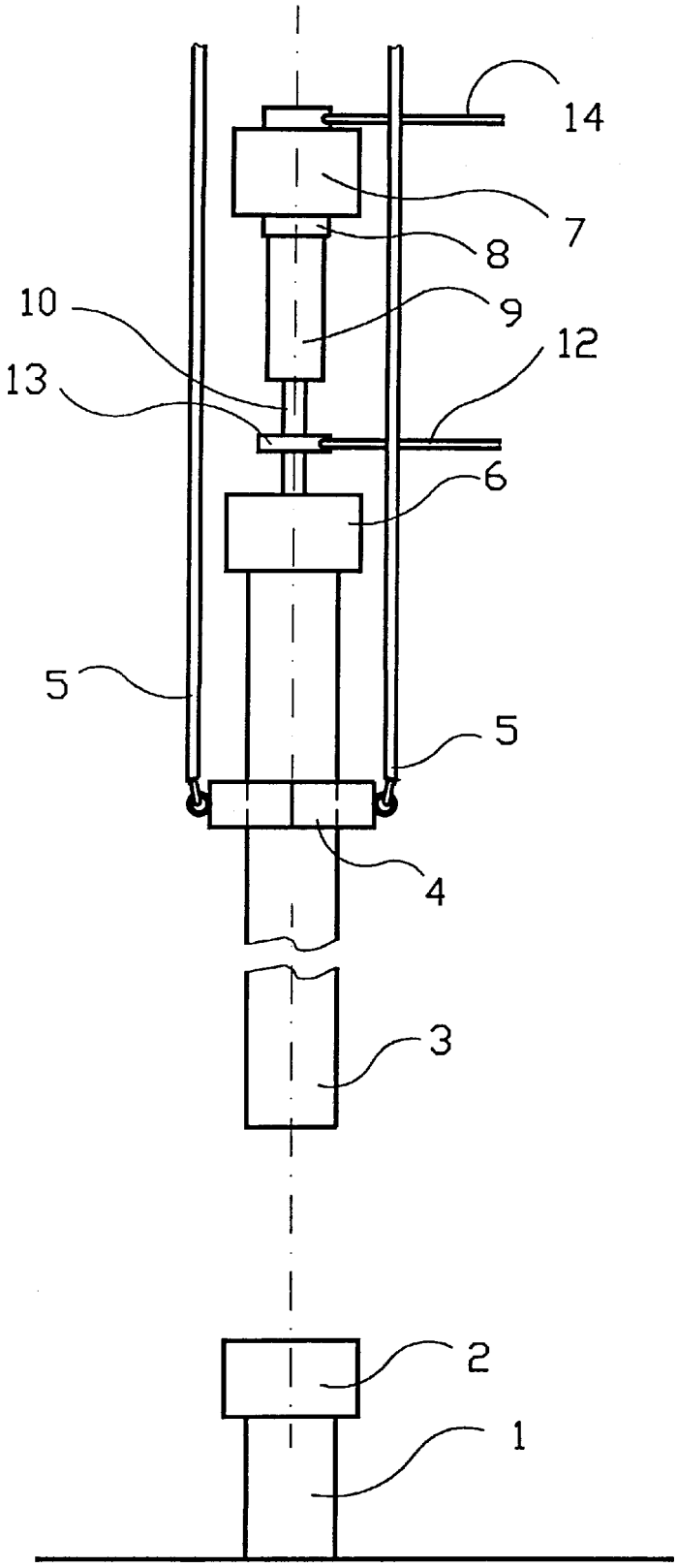
FIG. 3 shows the apparatus after the pipe has been raised in the elevator.
Figure 4:
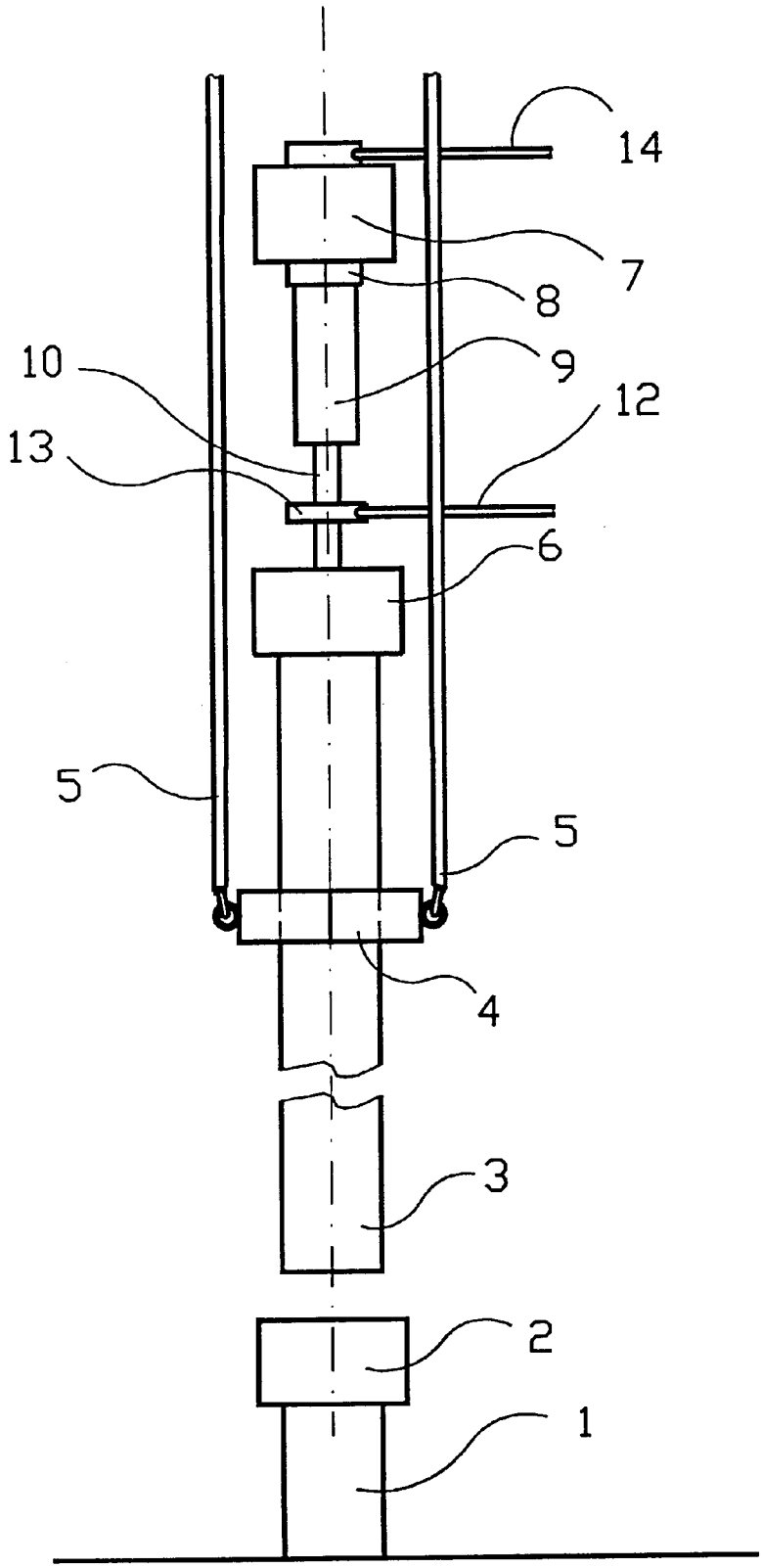
FIG. 4 shows the apparatus when the pipe is ready to be added to the top of the casing.
Figure 5:
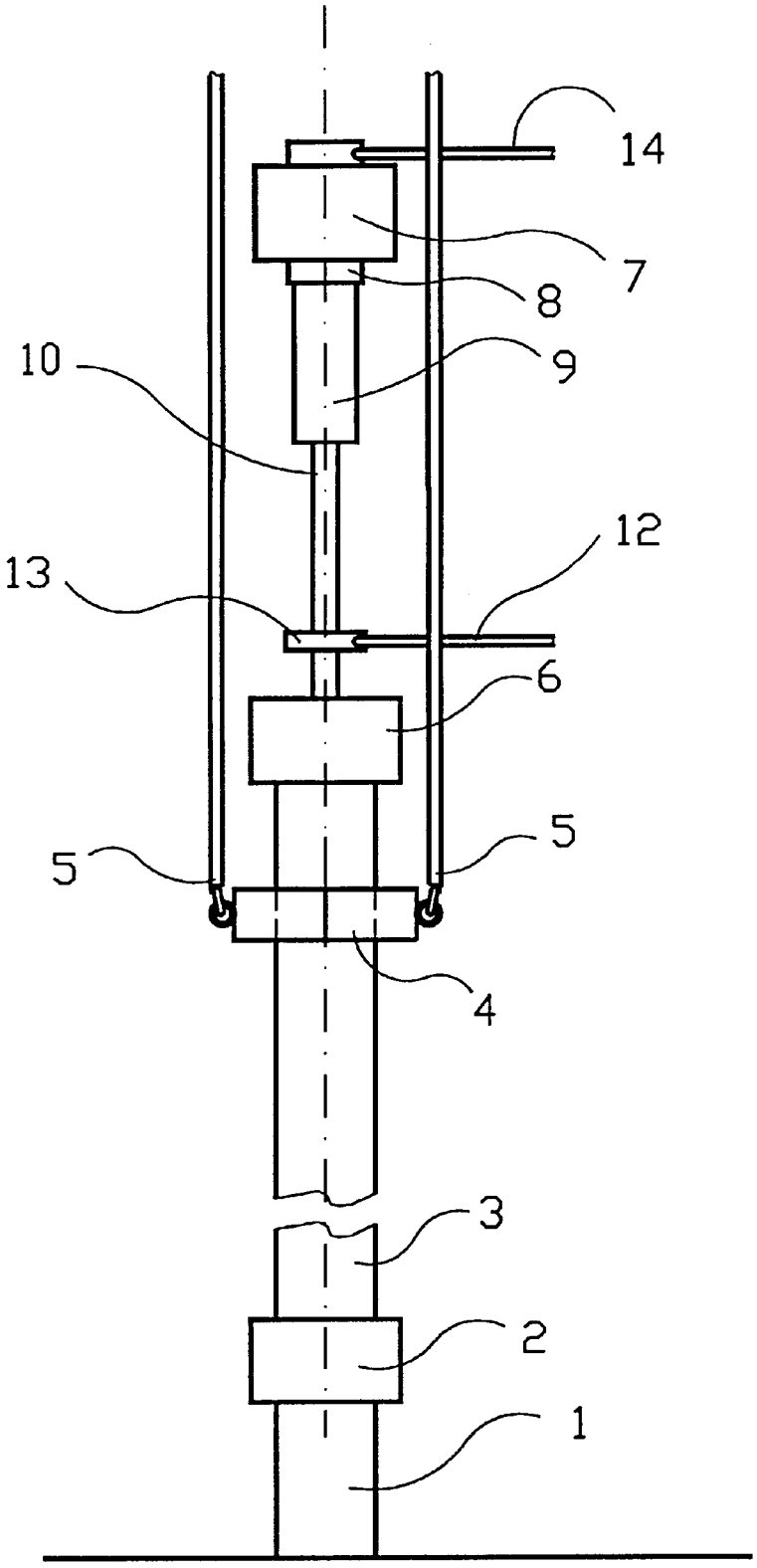
FIG. 5 shows the apparatus when the pipe is added to the top of the casing.

When a pipe 3 to be added to the top of a casing 1 is suspended from the elevator 4 by the collar 6 in a manner known per se as shown in FIG. 1, the unpressured bellows 15 is guided down into the pipe by means of the telescopic pipe 9 and the lower pipe member 10 as a result of activation of the hydraulic actuator, not shown, through the hoses 12 and the swivel device 13, se FIG. 2. The bellows 15 is pressurized through the pipe 19 as explained, so that the bellows 15 is expanded and forms a vigorous friction connection with the pipe 3. By means of said actuator, the pipe member 10 is pulled up and into the telescopic pipe 9, so that the pipe 3 is raised, sliding within the elevator 4, see FIG. 3. By means of said drawworks, hoisting pulley block carrying elevator 4 and top drive 7 is lowered until the lower end of the pipe 3 is situated a small distance above the socket 2 at the top of the casing 1, see FIG. 4. The pipe 3 is lowered further by extending the pipe member 10 out from the telescopic pipe 9 by means of said actuator, so that external threads at the lower end of the pipe 3 comes into engagement with the complimentary threads within the socket 2. The telescopic pipe 9, the pipe member 10 and, thus, also the pipe 3 are rotated about their own axis by means of the top drive 7, so that the pipe 3 is screwed into the socket 2. Simultaneously, the pipe 3 is lowered in step with the screwing as a result of the pipe member's 10 extension out from the telescopic pipe 9 by means of said actuator, see FIG. 5. Then, the threaded connection is tightened to prescribed moment as previously known by means of a moment tool, not shown. The casing 1, now extended, is lowered into the well and refilled with liquid through the telescopic pipe 9 and the pipe member 10 upon liquid supply from the pipe system 14. The pressure in the annulus 18 is relieved, and the bellows 15 is pulled up from the pipe 3 by pushing the pipe member 10 into the telescopic pipe 9 by means of said actuator, whereafter the process is repeated in order to add yet another pipe to the top of the casing 1.

What is claimed is:

1. A device for use in apparatus connecting a new pipe (3) to an elongated, vertical casing (1), said apparatus having an elevator (4) for suspending the new pipe over an upper end of the casing and having a top drive (7) disposed above the elevator, said top drive having a rotatable output shaft, said device comprising:

a pressure fluid operated, telescopic pipe device (9,10) having an upper end connected to the output shaft of said top drive (7), said telescopic pipe device having a downwardly extending, vertically movable member (10) with a lower end; and a catcher (11) coupled to the lower end of said telescopic pipe device and adapted to be inserted into an upper end of the new pipe when the new pipe is suspended from the elevator to establish a frictional connection with only a portion of an inner wall of the new pipe which is sufficient to enable the new pipe to be raised or lowered by movement of said vertically movable member, said frictional connection also being sufficient to resist torsional forces arising when the new pipe is engaged with the casing and rotated by said top drive, said catcher comprising;

an elastic, inflatable bellows (15) formed of a preshaped, hollow body having a central sleeve portion surrounding said vertically movable member (10) which is positioned intermediate end portions, said end portions tapering in opposite directions from said central portion toward a respective end thereof, said respective ends of said end portions being attached fluid tightly and with torsional strength to said vertically movable member of said telescopic pipe device (9,10), said bellows (15) being dimensioned for unobstructed insertion/withdrawal in relation to the new pipe when in an uninflated state and, when in the inflated state, to establish the frictional connection with the portion of the inner wall of the new pipe (3).

2. The device as set forth in claim 1 wherein said bellows is formed of a material exhibiting elastic deformation properties and wherein said respective ends of said end portion of said hollow body are attached to said telescopic pipe device by means of surrounding clamps.

3. The device as set forth in claim 1 further including a pressurized fluid conduit in said telescopic pipe device and extending along said telescopic pipe device, said pressurized fluid conduit having an opening within said inflatable bellows for supplying and removing inflating fluid to/from said bellows.

4. The device as set forth in claim 1 wherein said vertically movable member 10 of said telescopic pipe device is hollow for supplying liquid to the interior of the new pipe.

* * * * *